United States Patent [19]

Snyder et al.

[11] Patent Number: 4,553,700

[45] Date of Patent: Nov. 19, 1985

[54] CENTRIFUGAL SPRAYER HAVING HOLLOW CONE FEEDER

[75] Inventors: Irving F. Snyder, Minneapolis; Duane A. Luebeck, Blaine, both of Minn.

[73] Assignee: Polaris Home Systems, Inc., Minneapolis, Minn.

[21] Appl. No.: 590,769

[22] Filed: Mar. 19, 1984

[51] Int. Cl.[4] ..... B05B 3/10

[52] U.S. Cl. ..... 239/215; 239/222; 239/223

[58] Field of Search ..... 239/215, 216, 218.5, 239/222, 219, 223

[56] References Cited

U.S. PATENT DOCUMENTS 3,668,996 6/1972 Peiffer et al. ..... 239/216 X 4,294,408 10/1981 Snyder et al. ..... 239/218.5

FOREIGN PATENT DOCUMENTS 78193 10/1954 Denmark ..... 239/215

*Primary Examiner*—Andres Kashnikow
*Assistant Examiner*—David P. Davidson
*Attorney, Agent, or Firm*—James R. Haller

[57] ABSTRACT

A centrifugal sprayer of the type having an electric motor driving a disc element, and coupled to a feed mechanism suspended in immersion in a container of liquid to be sprayed, including an external axially supporting bushing surface about the cone feeder, wherein the lower feed opening of the cone feeder is supported by a mating conical bushing surface, thereby providing laminar flow to the inlet of the cone feeder.

4 Claims, 2 Drawing Figures

CENTRIFUGAL SPRAYER HAVING HOLLOW CONE FEEDER

BACKGROUND OF THE INVENTION

The present invention relates to centrifugal sprayers, and more particularly to centrifugal sprayers having a motor driven disc element fixedly attached to a liquid feed element, wherein the liquid feed element is attached to the disc and is suspended and immersed into a supply of liquid to be sprayed.

U.S. Pat. No. 4,294,408, issued Oct. 13, 1981, shows a centrifugal sprayer of the type generally related to the present invention. In this type of sprayer a rotating disc is suspended over a supply of liquid to be sprayed, and a feed mechanism is connected to pump liquid up to the spinning surface of the disc where it is centrifugally hurled outwardly in atomized form through a variable gate, to be deposited upon a surface. The aforementioned patent shows a feed mechanism comprising a screw pump, wherein the screw is contained within a tube in immersion in the liquid to be sprayed, and is direct-coupled to the drive mechanism which rotates the disc, so that as the disc is rotated the screw pump also rotates, thereby conveying liquid upwardly and into contact with the spinning surface of the disc. The screw pump mechanism performs adequately for some types of liquids and under certain conditions, but does suffer from a number of disadvantages. Among these disadvantages is the screw, while being immersed in the liquid to be pumped, causes continual agitation of the liquid with resulting aeration of the liquid, which reduces the pumping flow rate of the mechanism. Further, the screw pump is quite difficult to clean, especially when liquids such as paints are being sprayed by the device.

U.S. Pat. No. 3,668,996, issued June 13, 1972, shows a centrifugal atomizer having a rotatable hollow cone immersed in liquid, and connected to a disc for feeding liquid onto the disc for atomization. The cone and disc are formed from a single part, and are attachable to the shaft of a drive motor for uniform rotation. This construction suffers from the disadvantage of being difficult to clean, and from the further disadvantage of rotational instability at high rotational speeds, particularly when high viscosity liquids are sprayed. The cone is supported along an annular line at a point proximate the top of the cone, and high rotational speeds can cause instability of the cone as it is immersed in liquid.

U.S. patent application Ser. No. 565,400, filed Dec. 27, 1983, and owned by the same assignee as the present invention, shows a centrifugal sprayer having a motor driven disc and cone feed mechanism, wherein at least several different cone angles may be utilized for the feed mechanism in interchangeable relationship. It includes an outer housing which performs the multiple functions of collecting excess liquid and draining back to the liquid reservoir in which the cone is immersed, preventing the formation of a liquid vortex at the bottom of the cone feed mechanism, and providing a supporting bushing surface for guiding the cone in stable rotational operation. The disc and outer housing are constructed so as to enable the use of interchangeable cone feed members, wherein different cone angles may be incorporated to better control the pigment separation of different liquids.

SUMMARY OF THE INVENTION

The present invention is an improvement over the foregoing disclosures, providing the advantages disclosed therein with a simpler constructon, while at the same time providing considerably improved efficiency of spraying, and an improved result in the coating which is applied by the sprayer. The invention resides in a centrifugal sprayer having a motor driven disc, cone feed mechanism, and housing about the cone feed mechanism for drainage of excess liquid and other purposes, wherein the cone feed mechanism utilizes a single cone angle, and wherein an elongated axial bushing surface is provided between the external surface of the cone feed mechanism and the housing which surrounds the cone feed mechanism. The axial bushing support of the cone feed mechanism is further extended to include axial support proximate the lower end of the cone feed mechanism, thereby eliminating any gap between the cone feed mechanism and the outer housing so as to reduce liquid turbulence proximate the entry point of the cone feed mechanism.

It is a principal object of the present invention to provide a rotating cone feed mechanism having axial support along its axis of rotation, and having nonturbulent flow of liquid into its receiving entry port.

It is another object of the present invention to provide a rotating cone feed mechanism having a bearing support for guiding the rotating member in stable rotating operation.

It is yet another object of the present invention to provide a centrifugal paint sprayer having nonturbulent flow through its feed mechanism, thereby minimizing air bubbles and discontinuities in the paint film which is centrifugally applied by the spinning disc.

The foregoing and other advantages and objects will become apparent from the following specification and claims.

DESCRIPTION OF THE PREFERRED EMBODIMENT

Figure 1:
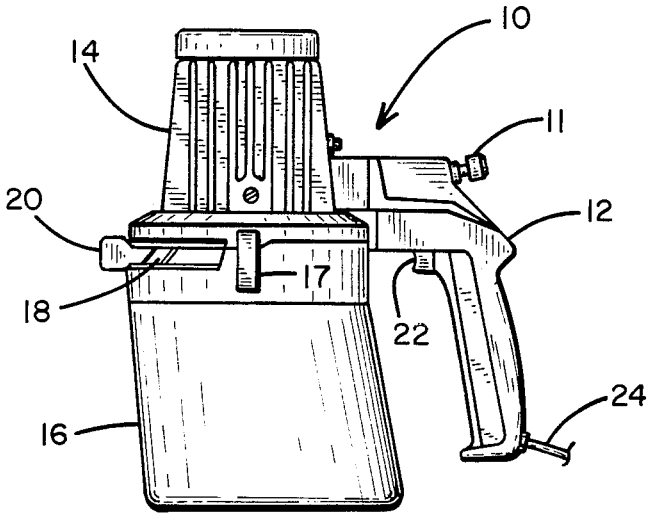
FIG. 1 shows the invention in elevation view.

Referring first to FIG. 1 there is shown a sprayer 10 of the type in which the invention is adapted for use. Sprayer 10 has a handle 12 for grasping by an operator, for maneuvering sprayer 10 for purposes of applying coating such as paint on various surfaces. Handle 12 is rigidly attached to a motor housing 14, which housing supports an electric motor therein. The electric motor in housing 14 has its drive shaft 15 (FIG. 2) facing vertically downwardly. A container 16 for containing a supply of paint is removably attached to motor housing 14 by means of one or more attachment clips 17. An opening is formed along the upper edge of container 16, and a slidable gate 20 is movably positioned to vary the size of opening 18. Sprayer 10 is actuable by a trigger 22, which trigger 22 is connected to a switch for coupling electrical power via power cord 24 to drive the motor within housing 14. A variable speed control 11 may be adjusted to control the rotational speed of the motor in the range of 3,000–15,000 revolutions per minute (rpm).

Figure 2:
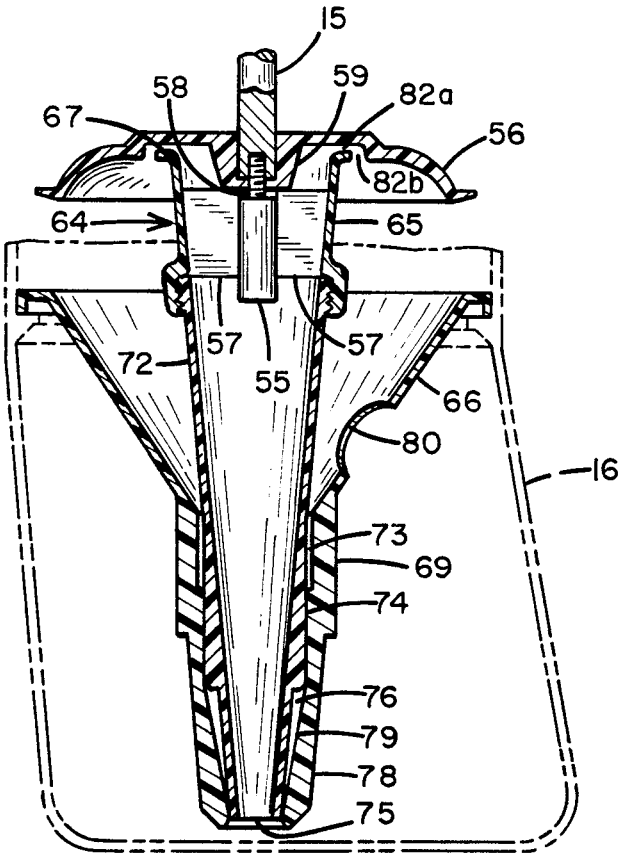
FIG. 2 shows a partial cross-section view of the invention.

FIG. 2 shows a cross-sectional view of a portion of sprayer 10, particularly illustrating the invention.

Motor shaft 15 is fixedly attached to a sleeve 55 by means of a fastener 58, fastener 58 being frictionally engageable within sleeve 55 so as to prevent rotation therebetween. Disc 56 is clamped between sleeve 55 and motor shaft 15 by virtue of hub 59 which fits over the end of shaft 15. Sleeve 55 is rigidly attached to an upper section 65 of cone feeder 64 by means of a plurality of radial supports 57. Upper section 65 is threadably attached to a further cone section 72. Cone section 72 extends downwardly and is axially seated within outer housing 66 for free rotation therein. Cone section 72 has an outer cylindrical surface section 74, surface section 74 being positioned so as to fit inside of a corresponding tubular section 69 on outer housing 66. Cylindrical surface section 74 extends axially along cone section 72 for a predetermined distance. The cylindrical inside surface of tubular section 69 on housing 66 extends axially for a predetermined lesser distance than surface section 74, thereby providing an annular opening 73 between the upper end of section 74 and the upper interior extension 79 of tubular section 69. Annular opening 73 allows for a small amount of liquid accumulation between surface 74 and the inside surface of tubular section 69. This liquid accumulation provides a constant source of lubrication between the moving surface of the cone and the fixed surface of tubular section 69.

The lower end 78 of outer housing 66 has an interior axial opening which is formed into a cone shape, so as to closely mate against the corresponding lower edge of cone section 72. The lower end 78 of the housing is shown extending downwardly beyond the opening 75 of the cone proximate the bottom of the container. The mating end surfaces formed thereby create a negligible annular gap therebetween to restrict the flow of liquid downwardly between cone section 72 and housing 66. Liquid accumulations in annular openings 73 and 76 are thereby prevented from rapidly flowing downwardly into the region of liquid feed opening 75, thereby causing negligible agitation of the liquid in the region of opening 75. Cone section 72 therefore has a lower liquid feed opening 75 which is constructed so as to admit liquid into the interior conical opening of cone section 72 under laminar flow conditions, and free from turbulence.

Outer housing 66 has an opening 80 therethrough, so as to provide a drainage point for excess accumulations of liquid along the inside surface of outer housing 66. A predetermined quantity of liquid will accumulate along the interior surface of outer housing 66 at points below opening 80, and this liquid will lubricate the axial mating surfaces during operation of the sprayer.

The top edge 67 of cone feeder 64 is affixed relative to the lower surface of disc 56 to provide a predetermined annular gap 82*a*. In practice, this annular gap is preferably about 0.010 inch. Top edge 67 is formed into a curved or radially extending flange which extends a predetermined distance towards disc 56 to provide a further annular gap 82*b*, which preferably is equal or less in width than annular gap 82*a*. By controlling the size of the flange of top edge 67, it is possible to control the size of annular gap 82*b*. It has been found in practice that the optimum size of annular gap 82*b* is a function of the type of liquid being sprayed by sprayer 10. For example, it has been found that an annular gap 82*b* of 0.010 inch is preferable for spraying light stains, and an annular gap 82*b* of 0.020 inch is preferable for spraying latex paints.

In operation, container 16 is filled with a predetermined quantity of liquid to be sprayed such as paint or the like. When the motor is actuated by depressing trigger 22 the motor shaft 15 causes disc 56 and cone section 72 to rotate at the same speed as the motor. Initially, the liquid accumulations inside the hollow interior of cone section 72 will be at the same level as the liquid of container 16, and upon rotation of cone section 72 this interior liquid will become centrifugally driven along the interior cone section surface to the top of cone section 72. An annular gap 82 is provided between the top of cone section 72 and disc 56, thereby providing an escape for the liquid contained therein under centrifugal forces. The liquid escaping from annular gap 82 becomes distributed over the lower surface area of disc 56, and ultimately is hurled outwardly in atomized form by the spinning disc, against the inside surface of the upper portion of container 16. The opening 18 provided therein permits a portion of this liquid to escape from container 16, in the form of fine atomized droplets, and this escaping material is applied as coating to a surface. The adjustable gate 20 permits selective variation of the amount of material which is permitted to escape, and thereby provides a control over the pattern width of the sprayed paint. The remaining paint which is hurled from the spinning disc 56 is collected along the inner surface of the upper section of container 16, and drains downwardly over the inside surface of outer housing 66 and back into containter 16.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A centrifugal sprayer of the type having a disc member attached to a rotatable drive member proximate the top of a liquid container which is itself attachable to a housing enclosing the rotatable drive member, comprising (a) a hollow cone member attached to said rotatable drive member in spaced relation to said disc, to provide an annular gap therebetween, said cone member having a conical interior surface with an opening positioned proximate the bottom of said container, said cone member further having an exterior cylindrical surface section segment; and (b) an outer funnel-shaped housing supported in said container, said housing having an upper cone shaped portion encircling said hollow cone member in spaced relationship, and having an interior cylindrical surface section segment in at least partial alignment with said cone member exterior cylindrical surface section segment, and having a lower internal surface closely fitted to said cone member, whereby during rotation of said cone member bearing surfaces are formed between said aligned cylindrical surfaces.

2. The apparatus of claim 1, wherein said hollow cone member further comprises an exterior conical surface area segment at its lower end, and said outer housing further comprises a lower internal conical surface aligned with said cone member exterior conical surface area segment.

3. The apparatus of claim 2, further comprising an opening through said outer housing in the upper cone shaped portion.

4. The apparatus of claim 1 wherein the housing has a lower end extending downwardly beyond the cone opening proximate the bottom of the container.

* * * * *